United States Patent [19]

Loubinoux et al.

[11] Patent Number: 5,034,261

[45] Date of Patent: Jul. 23, 1991

[54] THERMO-BONDING INTERLINING CONTAINING MICROFILAMENTS

[75] Inventors: Dominique Loubinoux, Lyons; Robert Bolliand, Ecully; Gérard Lamure, Beynost, all of France

[73] Assignee: Institut Textile De France, France

[21] Appl. No.: 450,738

[22] Filed: Dec. 14, 1989

[51] Int. Cl.[5] ..... B32B 27/14

[52] U.S. Cl. ..... 428/198; 428/195; 428/297; 428/299

[58] Field of Search ..... 428/198, 195, 297, 299, 428/343

[56] References Cited

U.S. PATENT DOCUMENTS

| | | | |
|---|---|---|---|
| 4,373,000 | 2/1983 | Knoke et al. | 428/198 |
| 4,514,455 | 4/1985 | Hwang | 428/198 |
| 4,623,575 | 11/1986 | Brooks et al. | 428/198 |
| 4,801,482 | 1/1989 | Goggins et al. | 428/299 |
| 4,818,594 | 4/1989 | Albien et al. | 428/299 |
| 4,970,104 | 11/1990 | Radwonski | 428/198 |

*Primary Examiner*—James J. Bell

*Attorney, Agent, or Firm*—Ladas & Parry

[57] ABSTRACT

The thermo-bonding interlining is a nonwoven covered on one face with dots of thermo-bonding resin. According to the invention, the nonwoven is a web, containing no binder or thermo-fusible fibers, whose weight per square meter is between 50 and 150 g, and which is produced from filaments in a thermoplastic material, such as polyester; the mean diameter of the filaments is between 3 and 5 μm, and preferably 90% of the filaments have a diameter comprised between that range; intermingling of the filaments is obtained by streams of high pressure fluid, such as streams of water at pressures of 40 to 80 bars.

3 Claims, 1 Drawing Sheet

THERMO-BONDING INTERLINING CONTAINING MICROFILAMENTS

FIELD OF THE INVENTION

The present invention relates to the field of interlining, namely the stiffening of textile articles by fixing a stiffening piece on the underside of the article, and it relates in particular to an interlining which is thermo-bonding, due to the fact that the stiffening element called interlining is provided on its surface with a resin whose bonding properties are revealed by heat and that said interlining is fixed by being applied to the underside of the textile article under a certain pressure and at a predetermined temperature.

BACKGROUND OF THE INVENTION

Interlining is used in clothe-making whenever part of a garment requires stiffening, such as for example a shirt collar. Conventional methods have heretofore implied placing a specially finished cotton cloth, called buckram, between the two pieces composing the collar. But with wear, and in particular after repeated washes, the collar was often found to be deformed due to a different behavior of the pieces composing it, and even due to a displacement of the buckram inside the collar. One solution found to overcome this drawback has been to bond the reinforcing element to the article to be reinforced. Also, the finished cotton cloth being quite expensive when it is not actually seen, a solution has been to replace it with a nonwoven which is a cheaper product.

The nonwovens used as interlinings contain either a bonding agent, in the case of small stiffening pieces such as for stiffening the collar of a shirt or a blouse, or thermal bonding fibers in the case of complete interlining of women's clothes and raincoats. A bonding by thermo-fusible fibers is described, for example, in U.S. Pat. No. 4,373,000. A nonwoven interlining bonded by the melting of thermo-fusible fibers is more supple and more textile to the touch than a nonwoven interlining bonded with a binding agent.

It has however been found that another problem arises when using nonwovens as thermo-bonding interlining base. The dots of resin deposited on the nonwoven for bonding the interlining to the underside of the textile piece to be stiffened should not go through the interlining as this would risk to tighten up the said piece or even to stick the interlining to the lining.

Various solutions have been proposed to overcome this problem, the simplest one being the use of nonwovens having a high weight per square meter, generally higher than 150 g, but such weight affects the qualities of the interlining in certain fields of application. Another solution consists, before applying the thermo-bonding resin, in making a first coating designed to prevent the spreading of the resin when pressure is applied; this solution, however, is difficult to implement and noticeably increases the cost of the interlining.

FIELD OF THE INVENTION

It is the object of the invention to provide a thermo-bonding interlining containing no binder and/or thermo-fusible fibers, and which is not traversed by the thermo-bonding resin even if it is a low weight interlining.

This object is reached according to the invention with a thermo-bonding interlining consisting, conventionally, in a non-woven, covered on one face with dots of thermo-bonding resin. According to the invention, the nonwoven is a web, containing no binder or thermo-fusible fibers, whose weight per square meter is between 50 and 150 g, said web being produced from filaments of a thermoplastic material of mean diameter ranging between 3 and 5 μm, intermingled by a high pressure fluid stream.

Preferably, the filaments are in polyester, which is a synthetic material resistant to washing and dry-cleaning.

Preferably, 90% of the filaments have a diameter ranging between 3 and 5 μm.

The good results obtained with the interlining according to the invention may be explained by the large specific surface area provided by fibers much finer than the fibers constituting the conventional nonwovens, which have a diameter of about 15 μm. Moreover, the interlining according to the invention presents a unique feel and hang.

It is another object of the invention to provide a method specially devised for producing the aforesaid thermo-bonding interlining, said method consisting in:

(a) extruding from an extrusion plate whose holes have a diameter ranging between 200 and 300 μm, and spraying by compressed air stream of 0.5 to 3.5 bars, a thermoplastic material in molten state onto a conveyor belt, thereby producing a non-cohesive web of filaments, the mean diameter of which filaments is between 3 and 5 μm, (b) in moving said web, which lays over a wire screen type conveyor, under at least one row of high pressure fluid injectors, and in drying it if the fluid is a liquid, (c) in depositing on one face of the web of intermingled filaments, dots of thermo-bonding resin and in drying said resin.

Advantageously, the thermoplastic material is a polyester whose melting point is about 214° C., the extrusion takes place at a temperature of about 240° C. under nitrogen atmosphere and through an extrusion plate in which the holes are aligned in one row at a distance of 1 to 2 mm from one another, and the compressed air is sprayed at a temperature of about 240° C. through orifices provided in the extrusion plate.

Advantageously, the non-cohesive web passes under four rows of water injectors working at a pressure of, respectively, 40, 60, 70 and 80 bars, in the moving direction of the web on the wire screen conveyor. To improve the intermingling of the filaments, the web is preferably caused to pass twice under said four rows of injectors, the first time with the sprays being directed onto one face, and the second time with the sprays directed onto the other face.

It is another object of the invention to provide a textile article on which said thermo-adhesive interlining, containing no binder or thermo-fusible fibers, has been applied by thermo-bonding, in a proportion of between 50 and 150 g per square meter, and which interlining contains no traversing dots of adhesive.

BRIEF DESCRIPTION OF THE DRAWINGS

The invention will be more readily understood on reading the following description of a preferred embodiment, with reference to the accompanying drawings, in which.

DETAILED DESCRIPTION OF PREFERRED EMBODIMENT

Figure 1:
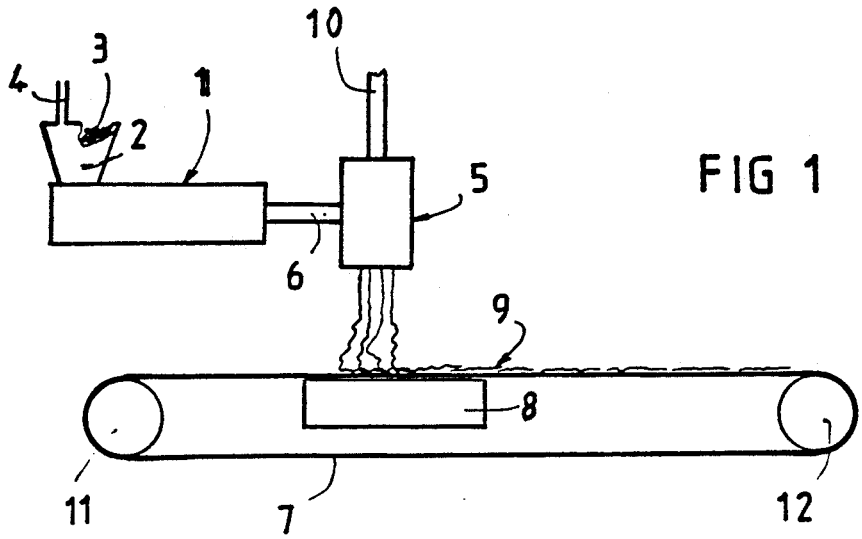
FIG. 1 is a diagrammatical side view of the installation for the production of a web of microfilaments without cohesion.

According to FIG. 1, the installation for producing the web comprises an extruder 1 equipped with a hopper 2. Said hopper 2 is filled with granules 3 of polyester. The polyester used has a melting point around 214° C. During the extrusion, the hopper 2 is kept under a neutral gas, such as nitrogen, introduced through an inlet tube 4, in order to prevent the steam in the ambient atmosphere from coming into contact with the molten polyester.

In extruder 1, the polyester is brought to a temperature of about 240° C., and it is mixed and driven towards the extrusion plate 5 via a connecting element 6. A wire mesh filter is placed in the connecting element 6 to hold back any impurities contained in the polyester granules 3. The extrusion plate 5 is provided with holes of 300 μm diameter, said holes being aligned in one row, one to two holes per mm.

Under the extrusion plate 5, an endless conveyor 7 is kept stretched between two drums 11 and 12, one 12 of which is driven in rotation by conventional means, not shown. The conveyor 7 is an air-permeable wire screen. Between the two ends of conveyor 7, a suction box 8 is provided immediately below the upper end of said conveyor 7.

The molten polyester is forced by the extruder 1 through the holes of the extrusion plate 5 whereas a stream of air heated to 240° C. is introduced through the duct 10, at a pressure varying between 0.5 and 3.5 bars, preferably 1 bar. Said hot air is directed towards rectangular outlet orifices, provided in the extrusion plate in the immediate vicinity of the extrusion holes. Accordingly, the polyester extruded through the extrusion holes is driven at high speed by the stream of hot air; it undergoes then an important drawing between 100 and 10,000, which brings its mean diameter to between 3 and 5 μm.

An analysis of the resulting filaments reveals a distribution ranging between 1 and 10 μm with a majority of filaments less than 5 μm.

The resulting microfilaments are sprayed over the conveyor 7 and held there by the suction produced by the box 8, and form a web 9 which is still non-cohesive. These microfilaments have a great length, being broken off only after an excessive drawing. The weight of the web per square meter is between 50 and 150 g, depending on the feeding conditions of the extruder 1 and on the speed of the conveyor 7. For a web having a weight of 60 g/m2, 90% of the filaments had a diameter of between 3 and 5 μm.

Figure 2:
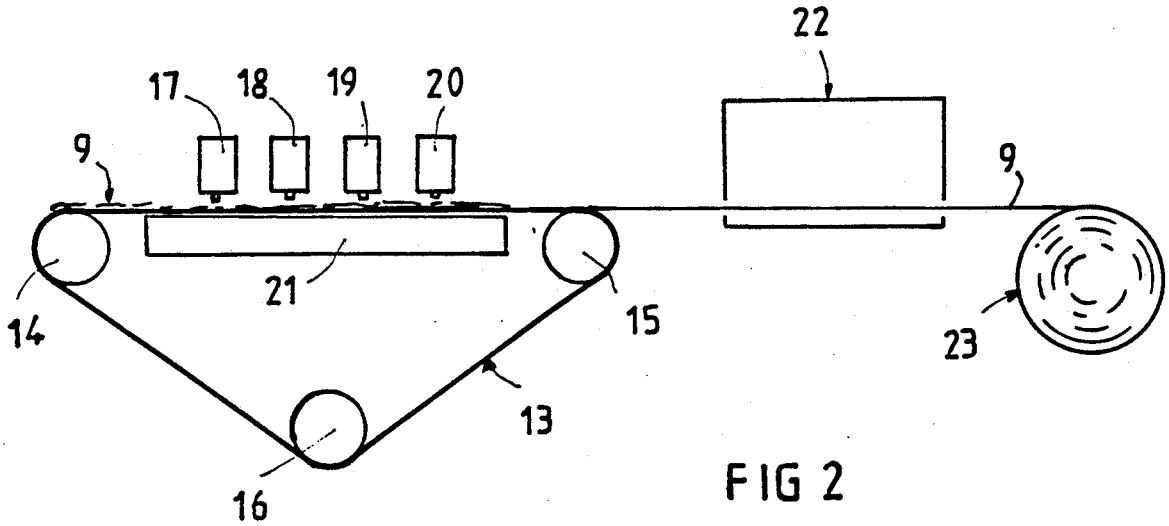
FIG. 2 is a diagrammatical side view of the installation for binding the web by intermingling of the microfilaments.

The obtained web 9 is then driven over the binding-by-intermingling installation, as illustrated in FIG. 2. In the case where the two operations are not continuous, the web 9 is wound up on emerging from the conveyor 7; in such a case, a sheet of polyethylene is preferably intercalated during the winding up in order to prevent subsequent irregular unwinding of the web 9.

The binding installation comprises an endless conveyor 13 stretched between two drums; in the illustrated example, there were three drums 14, 15, 16, one of which, 15, was driven in rotation by means not shown. Above the upper end of the conveyor 13, are placed four rows 17 to 20 of water injectors, fed under pressures equal, respectively, to 40 bars for the first row 17, 60 bars for the second row 18, 70 bars for the third row 19 and 80 bars for the fourth row 20.

The conveyor 13 is a wire screen. The water sprayed thereon by the injectors and bouncing off the wire screen moves the filaments of the web one with respect to the others. The density and diameter of the wires constituting the screen are so selected as to ensure the best intermingling output when the web 9 passes under the rows of injectors 17 to 20. In the illustrated example, the diameter of the wires was 0.5 mm and the screen had an opening of 30, meaning that the gaps between the meshes of the screen represented 30% of the total surface.

The water is recovered in suction boxes provided under the conveyor 13 vertically to the rows of injectors 17 to 20; it is recycled via a set of pumps, not shown.

The web 9 being thus consolidated goes through a drying tunnel 22 heated to a temperature of 180° C., after which it is wound up to form a reel 23.

The nonwoven obtained is smooth, very cohesive and not plushy. It had, in the illustrated example, a weight of 60 g per square meter. It is thereafter covered on one face with a dot-by-dot coating of thermo-bonding resin. Such deposition of dots of resin is performed with engraved cylinders, the resin being optionally deposited in paste state or in powder state. It can also be performed with a printing type perforated roller into which the paste is fed and then pushed out of said roller with a scraper through the perforations. The nonwoven on which the dots of resin have been deposited then passes through a drying tunnel.

In the illustrated example, the thermo-bonding resin was in the form of a polyamide paste; it was deposited by means of a printing-type perforated roller, equipped with 11 rows of holes for 25 mm, i.e. about 22 holes per cm2. Each perforation had a diameter of 1.8 mm and each dot of resin was 2 mm thick.

The thermo-bonding interlining thus obtained is very stable under heat. It is therefore suitable for interlining all types of garments, particularly those for which a good feel and hang are required. The thermo-bonding interlining is placed on the underside of the textile piece to be stiffened, and a high pressure under a temperature of about 140° C. is applied. The thermo-bonding resin is deposited on the underside of the textile piece without going through the nonwoven. The interlined article obtained with the thermo-bonding interlining according to the invention does not deform with wear.

What is claimed is:

1. Thermo-bonding interlining of the type consisting of a nonwoven covered on one face with dots of thermo-bonding resin, wherein the nonwoven is a web, containing no binder or thermo-fusible fibers, whose weight per square meter is between 50 and 150 g, said web being produced from filaments in thermoplastic material of mean diameter ranging between 3 and 5 μm intermingled by a stream of high pressure fluid.

2. Thermo-bonding interlining as claimed in claim 1, wherein the filaments being in polyester, 90% of said filaments have a diameter ranging between 3 and 5 μm.

3. Textile article comprising at least one interlining as claimed in claim 1, which interlining is thermo-bonded to said article.

* * * * *